US008207903B2

(12) United States Patent
Lu et al.

(10) Patent No.: US 8,207,903 B2
(45) Date of Patent: Jun. 26, 2012

(54) ANTENNA

(75) Inventors: Yi-Fong Lu, Taipei (TW); Yi-Cheng Lin, Taipei (TW); Kuo-Fong Hung, Taipei (TW)

(73) Assignee: National Taiwan University, Taipei (TW)

( * ) Notice: Subject to any disclaimer, the term of this patent is extended or adjusted under 35 U.S.C. 154(b) by 547 days.

(21) Appl. No.: 12/259,978

(22) Filed: Oct. 28, 2008

(65) Prior Publication Data

US 2009/0256765 A1 Oct. 15, 2009

(30) Foreign Application Priority Data

Apr. 9, 2008 (TW) ..... 97112781 A

(51) Int. Cl.
*H01Q 13/00* (2006.01)
*H01Q 9/04* (2006.01)

(52) U.S. Cl. ..... 343/767; 343/700 MS

(58) Field of Classification Search ..... 343/700 MS, 343/767, 768, 770, 771
See application file for complete search history.

(56) References Cited

U.S. PATENT DOCUMENTS

| | | | | |
|---|---|---|---|---|
| 4,360,813 | A * | 11/1982 | Fitzsimmons | 342/350 |
| 4,873,529 | A * | 10/1989 | Gibson | 343/700 MS |
| 6,188,396 | B1 * | 2/2001 | Boezeman et al. | 715/202 |
| 6,618,020 | B2 * | 9/2003 | Wang et al. | 343/767 |
| 6,879,296 | B2 * | 4/2005 | Jiang et al. | 343/767 |
| 6,940,460 | B2 * | 9/2005 | Maoz et al. | 343/702 |
| 6,992,637 | B2 * | 1/2006 | Hwang et al. | 343/770 |
| 7,522,119 | B2 * | 4/2009 | Jung et al. | 343/846 |
| 7,564,413 | B2 * | 7/2009 | Kim et al. | 343/702 |
| 7,724,192 | B2 * | 5/2010 | Liu | 343/700 MS |
| 2004/0137971 | A1 * | 7/2004 | Shoji | 455/575.5 |
| 2009/0079647 | A1 * | 3/2009 | Jung et al. | 343/767 |

* cited by examiner

*Primary Examiner* — Jacob Y Choi
*Assistant Examiner* — Hasan Islam

(57) ABSTRACT

An antenna is provided. The antenna includes a substrate, a feed conductor, a ground layer and a radiation slot. The substrate includes a first surface and a second surface, wherein the first surface is opposite to the second surface. The feed conductor is formed on the first surface. The ground layer is formed on the second surface. The radiation slot is formed on the ground layer, including a first radiation portion, a second radiation portion and a third radiation portion, wherein the second radiation portion connects the first radiation portion and the third radiation portion, the radiation slot is U shaped, and the feed conductor corresponds to a location between the second radiation portion and the third radiation portion.

8 Claims, 5 Drawing Sheets

ANTENNA

CROSS REFERENCE TO RELATED APPLICATIONS

This Application claims priority of Taiwan Patent Application No. 097112781, filed on Apr. 9, 2008, the entirety of which is incorporated by reference herein.

BACKGROUND OF THE INVENTION

1. Field of the Invention

The present invention relates to an antenna, and in particular relates to an antenna with increased bandwidth.

2. Description of the Related Art

U.S. Pat. No. 6,618,020 discloses a conventional slot antenna, comprising a radiating slot and a microstrip feed. The microstrip feed feeds a wireless signal to the radiating slot at an open end thereof.

The slot antenna disclosed in U.S. Pat. No. 6,618,020 has a simple structure and a narrow bandwidth, which cannot satisfy a broader range of signal transmission requirements.

BRIEF SUMMARY OF THE INVENTION

A detailed description is given in the following embodiments with reference to the accompanying drawings.

An antenna is provided. The antenna comprises a substrate, a feed conductor, a ground layer and a radiation slot. The substrate comprises a first surface and a second surface, wherein the first surface is opposite to the second surface. The feed conductor is formed on the first surface. The ground layer is formed on the second surface. The radiation slot is formed on the ground layer, comprising a first radiation portion, a second radiation portion and a third radiation portion, wherein the second radiation portion connects the first radiation portion and the third radiation portion, the radiation slot is U shaped, and the feed conductor corresponds to a location between the second radiation portion and the third radiation portion.

Bandwidth of the antenna (bandwidth is defined as signals having return loss lower than −10 dB) of the embodiment is between 800 to 900 MHz and between 1610 to 2700 MHz. Therefore, the antenna of the embodiment satisfies transmission requirements under GSM900, US-DVB-H, DCS1800, PCS1900, UMTS and IEEE802.11b. Additionally, in the bandwidth of the antenna, the antenna has radiation efficiency higher than 80%, omnidirectional divergence field and an antenna gain between 1 dBi to 3 dBi.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
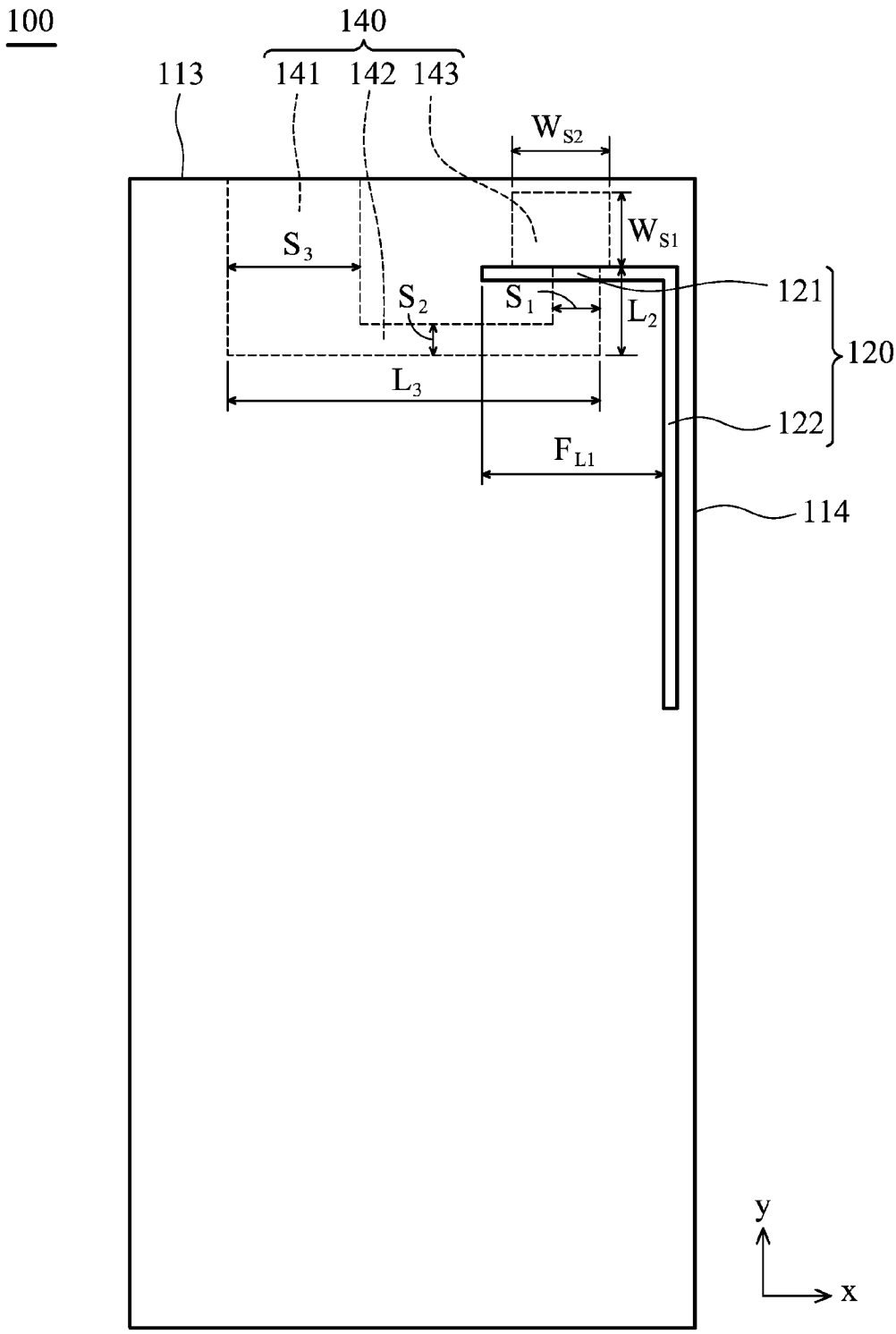
FIG. 1*a* is a top view of an antenna of an embodiment of the invention.
Figure 1B:
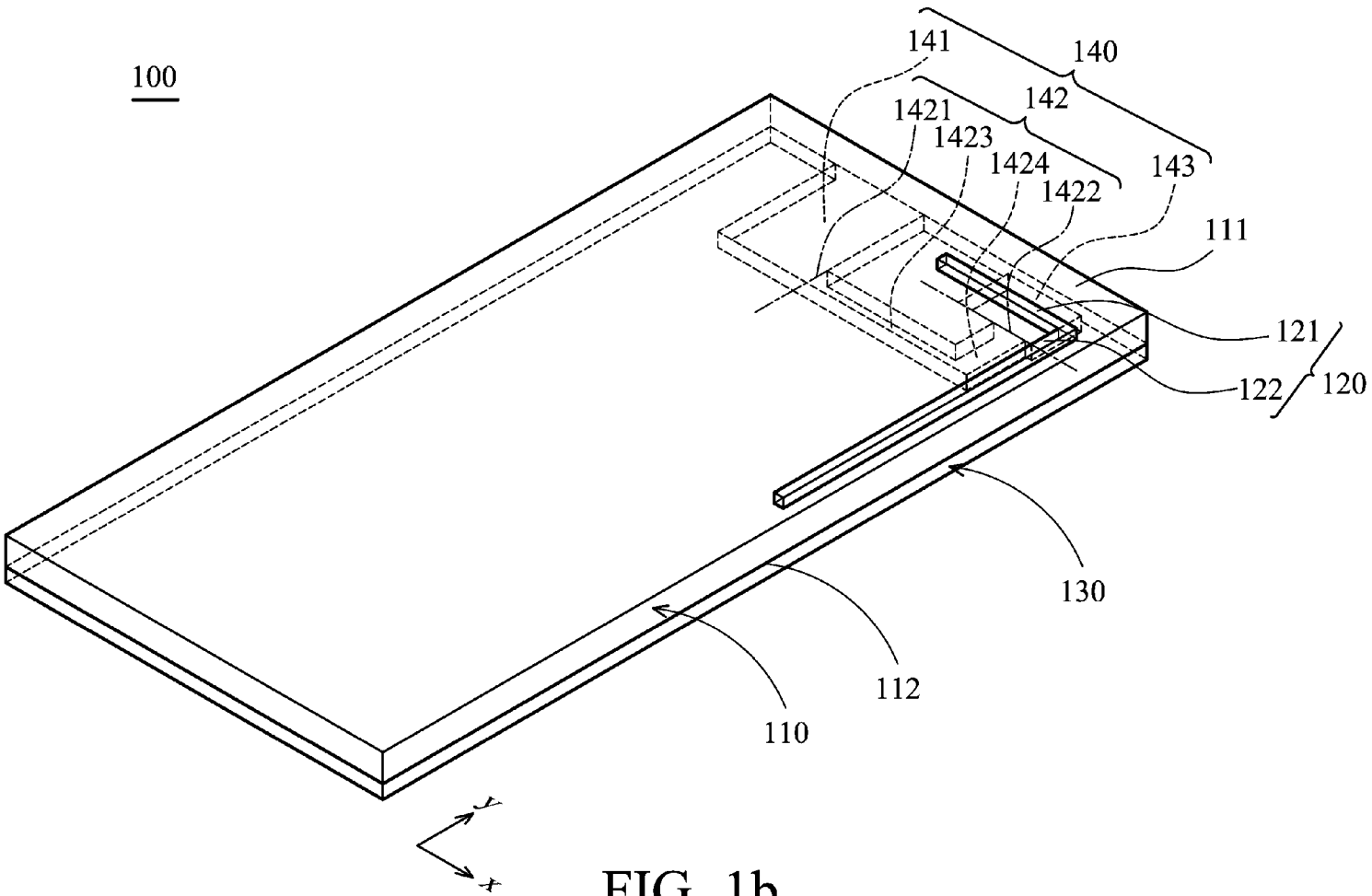
FIG. 1*b* is a perspective view of the antenna of the embodiment of the invention.

FIGS. 1*a* and 1*b* show an antenna 100 of an embodiment of the invention, comprising a substrate 110, a feed conductor 120, a ground layer 130 and a radiation slot 140. The substrate 110 comprises a first surface 111 and a second surface 112. The first surface 111 is opposite to the second surface 112. The feed conductor 120 is formed on the first surface 111. The ground layer 130 is formed on the second surface 112. The radiation slot 140 is formed on the ground layer 130. The radiation slot 140 comprises a first radiation portion 141, a second radiation portion 142 and a third radiation portion 143. The second radiation portion 142 is L shaped, comprising a first end 1421 and a second end 1422. The first end 1421 is connected, to the first radiation portion 141. The second end 1422 is connected to the third radiation portion 143. The feed conductor 120 is corresponding to the second end 1422.

The radiation slot 140 is substantially U shaped. The substrate 110 comprises a first edge 113 and a second edge 114. The first edge 113 is perpendicular to the second edge 114. The first radiation portion 141 extends to the first edge 113.

The second radiation portion 142 comprises a first section 1423 and a second section 1424. The first section 1423 is perpendicular to the second section 1424. The first end 1421 is located on the first section 1423. The second end 1422 is located on the second, section 1424. The width $S_1$ of the second section 1424 is larger than the width $S_2$ of the first section 1423. The width $S_3$ of the first radiation portion 141 is larger than the width $S_2$ of the first section 1473. The width $W_{S2}$ of the third radiation portion 143 is larger than the width $S_1$ of the second section 1424.

The second section 1424, the third radiation portion 143 and the first radiation portion 141 extend in a direction y parallel to the second edge 114. The first section 1423 extends in a direction x parallel to the first edge 113.

The feed conductor 120 is L shaped, comprising a first conductor section 121 and a second conductor section 122. The first conductor section 121 is perpendicular to the second conductor section 122. The first conductor section 121 is corresponding to the second edge 1422. The second conductor section 122 is parallel to the second edge 114.

Figure 2:
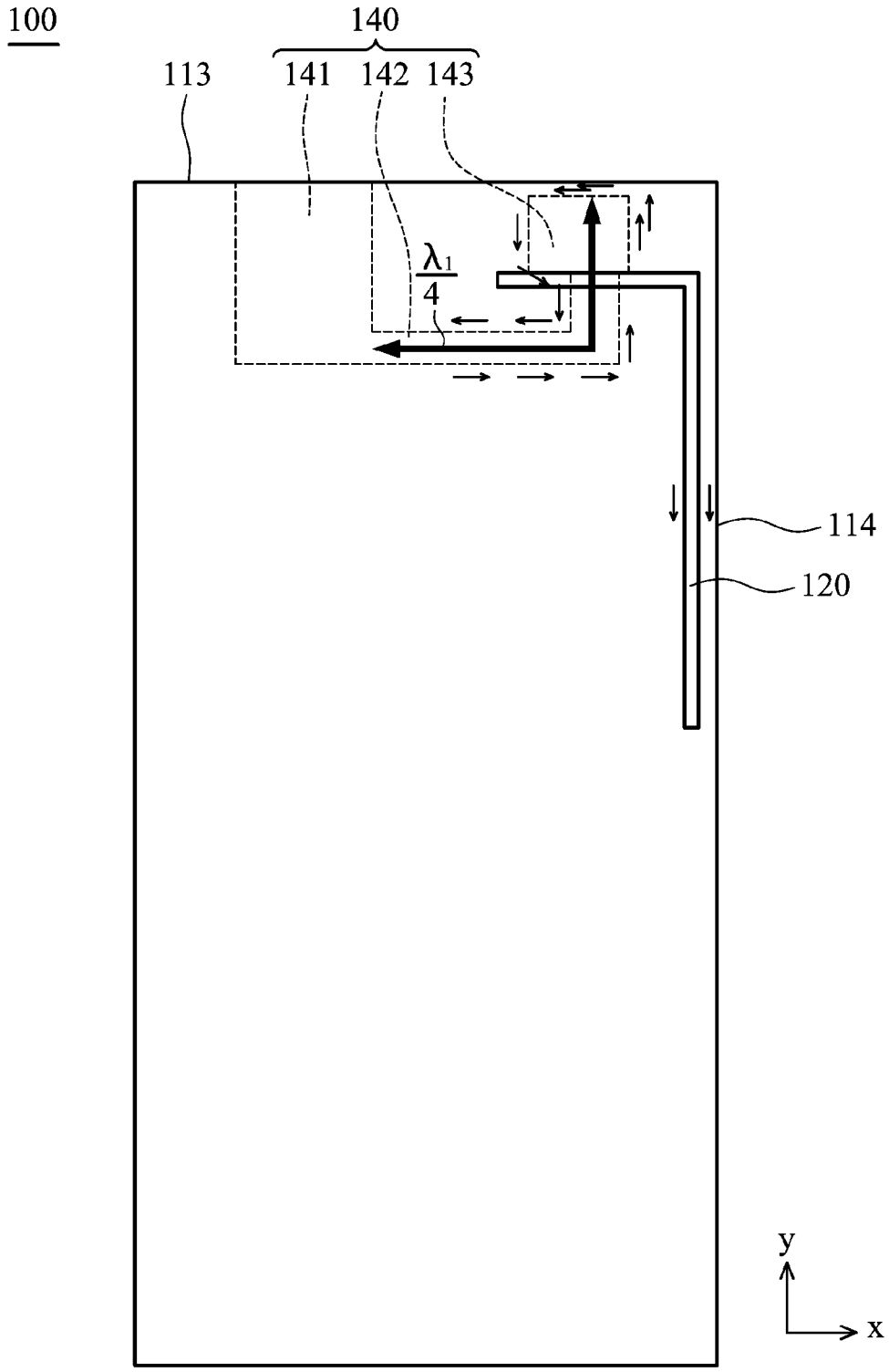
FIG. 2 shows a current path when the antenna of the embodiment of the invention transmits a low frequency signal (925 MHz)

FIG. 2 shows a current path when the antenna 100 of the embodiment of the invention transmits a low frequency signal (925 MHz). The antenna 100 transmits the low frequency signal via the second radiation portion 142 and the third radiation portion 143. The sum of the length of second radiation portion 142 and the length of the third radiation portion 143 substantially equals to a quarter of the wave length $\lambda_1$ of the low frequency signal.

Figure 3:
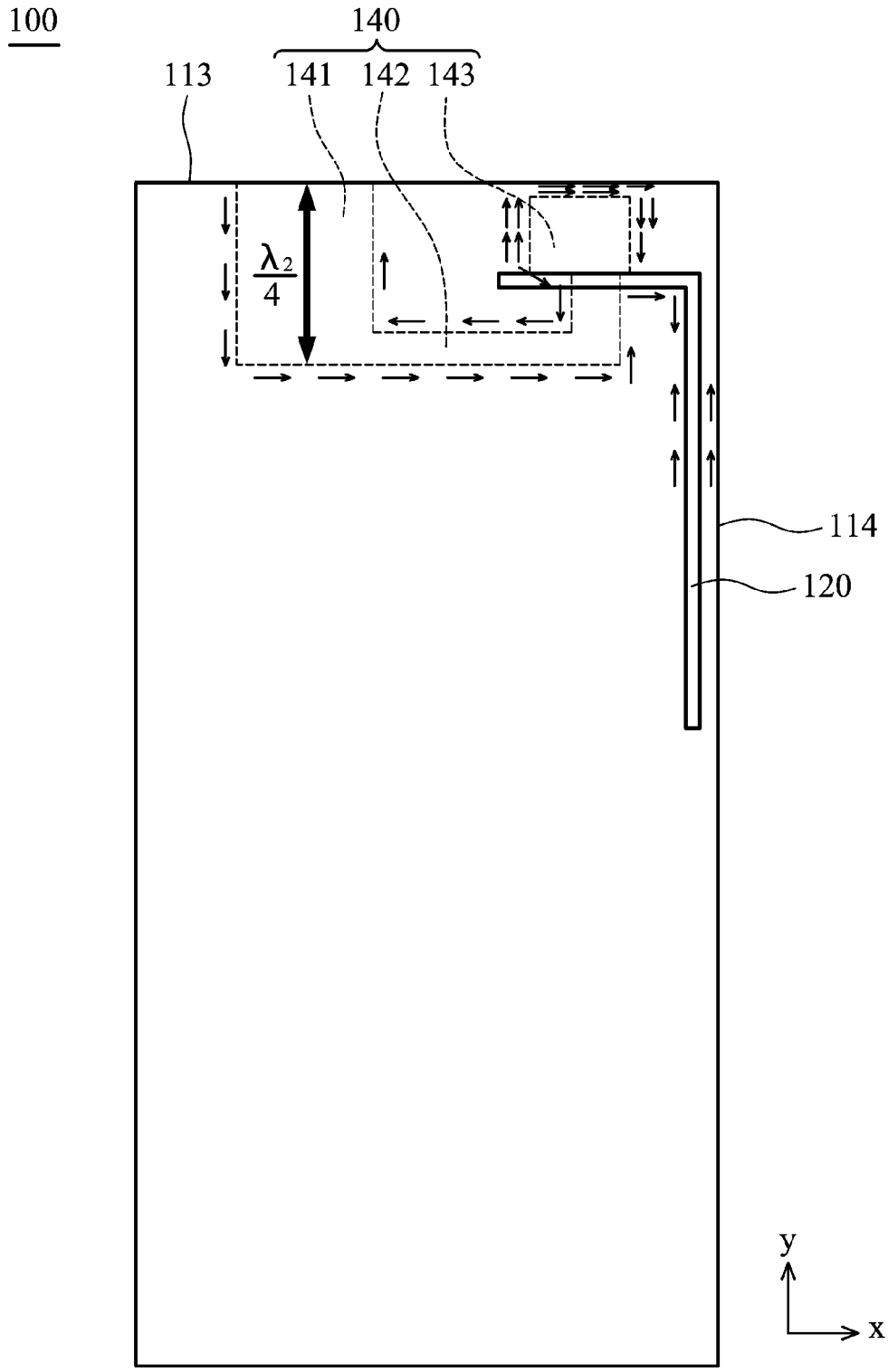
FIG. 3 shows a current path when the antenna of the embodiment of the invention transmits a high frequency signal (1795 MHz)

FIG. 3 shows a current path when the antenna 100 of the embodiment of the invention transmits a high frequency signal (1795 MHz). The feed conductor 120 feeds (couples) the high frequency signal to the second radiation portion 142, and the high frequency signal is fed to first radiation portion 141 via the second radiation portion 142. The length of the first radiation portion 141 substantially equals to a quarter of the wave length $\lambda_2$ of the high frequency signal.

With reference to FIG. 1*a*, in the embodiment of the invention, the width $S_1$ of the second section 1424 is 4.9 mm, the width $S_2$ of the first section 1423 is 1.85 mm, the width $S_3$ of the first radiation portion 141 is 14 mm, the length $W_{S1}$ of the third radiation portion 143 is 8 mm, the width $W_{S2}$ of the third radiation portion 143 is 8 mm, the length $L_2$ of the second section 1424 is 8 mm, the total length $L_3$ of the radiation slot 140 is 39 mm, and the length $F_{L1}$ of the first conductor section 121 is 19.86 mm. The dimensions disclosed above do not limit the invention.

Figure 4:
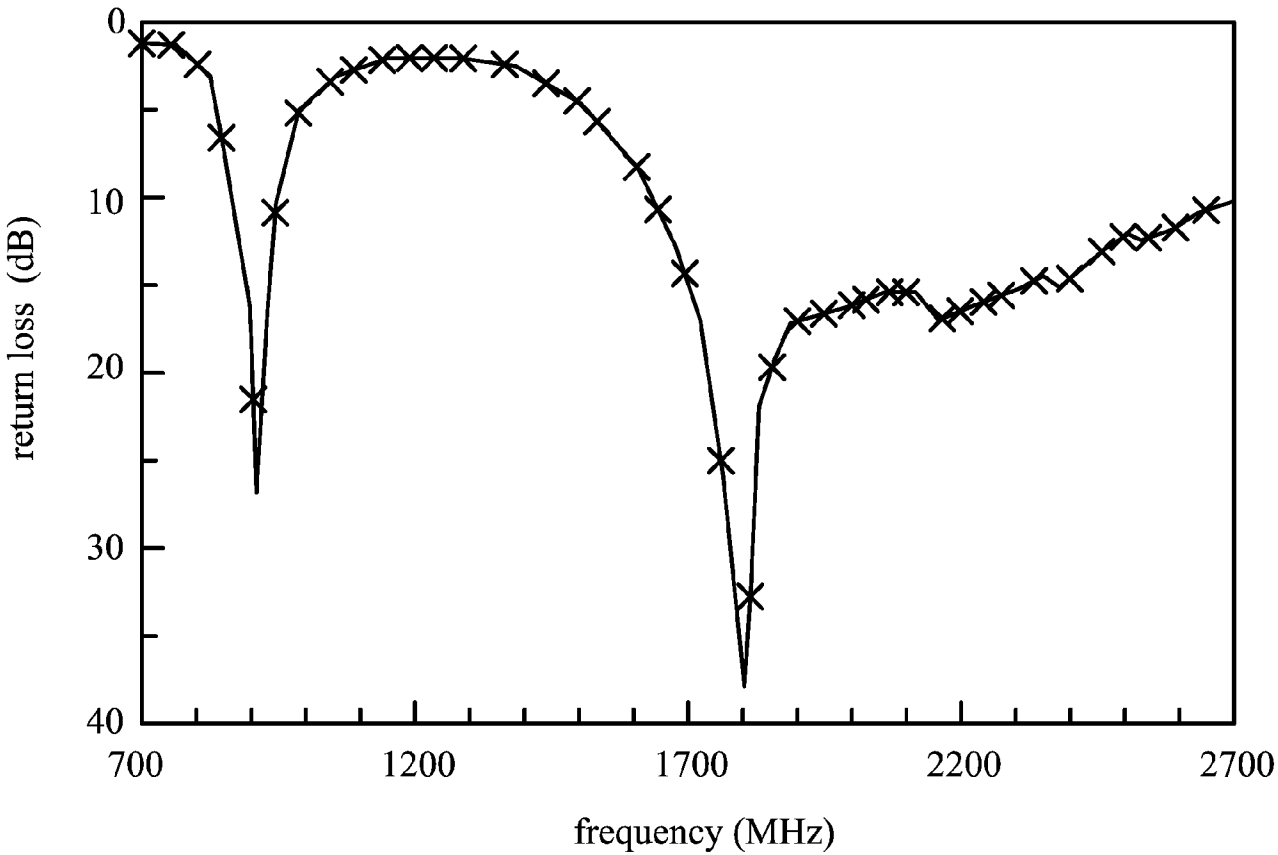
FIG. 4 shows signal transmission of the antenna of the embodiment of the invention.

FIG. 4 shows signal transmission of the antenna 100 of the embodiment of the invention. As shown in FIG. 4, bandwidth of the antenna 100 bandwidth is defined as signals having return loss lower than −10 dB) is between 800 to 900 MHz and between 1610 to 2700 MHz. Therefore, the antenna 100 of the embodiment satisfies transmission requirements under GSM900, US-DVB-H, DCS1800, PCS1900, UMTS and IEEE802.11b. Additionally, in the bandwidth of the antenna 100, the antenna 100 has radiation efficiency higher than 80%, omnidirectional divergence field and an antenna gain between 1 dBi to 3 dBi.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a substrate, comprising a first surface and a second surface, wherein the first surface is opposite to the second surface; a feed conductor, formed on the first surface; a ground layer, formed on the second surface; and a radiation slot, formed on the ground layer, wherein the radiation slot is substantially U shaped, comprising:

a first radiation portion; a second radiation portion, comprising a first end and a second end, wherein the second radiation portion is L shaped, and the first end is connected to the first radiation portion; and a third radiation portion, wherein the second end is connected to the third radiation portion, and the feed conductor is corresponding to the second end, wherein the second radiation portion comprises a first section and a second section, the first section is perpendicular to the second section, the first end is located on the first section, the second end is located on the second section, and a width of the second section is larger than a width of the first section;

wherein when the antenna transmits a low frequency signal, the antenna transmits the low frequency signal via the second radiation portion and the third radiation portion, wherein when the antenna transmits a high frequency signal, the antenna transmits the high frequency signal via the first radiation portion.

2. The antenna as claimed in claim 1, wherein the substrate comprises a first edge and a second edge, the first edge is perpendicular to the second edge, and the first radiation portion extends to the first edge.

3. The antenna as claimed in claim 2, wherein the feed conductor is L shaped, the feed conductor comprises a first conductor section and a second conductor section, the first conductor section is perpendicular to the second conductor section, the first conductor section is corresponding to the second end, and the second conductor section is parallel to the second edge.

4. The antenna as claimed in claim 1, wherein a width of the first radiation portion is larger than the width of the first section.

5. The antenna as claimed in claim 1, wherein a width of the third radiation portion is larger than the width of the second section.

6. The antenna as claimed in claim 1, wherein the second section and the third radiation portion extend in a direction parallel to an extended direction of the first radiation portion.

7. The antenna as claimed in claim 1, wherein when the antenna transmits the high frequency signal, the feed conductor couples the high frequency signal to the second radiation portion, and the high frequency signal is feed to the first radiation portion via the second radiation portion.

8. An antenna, comprising:

a substrate, comprising a first surface and a second surface, wherein the first surface is opposite to the second surface;

a feed conductor, formed on the first surface;

a ground layer, formed on the second surface; and a radiation slot, formed on the ground layer, wherein the radiation slot is substantially U shaped, comprising:

a first radiation portion;

a second radiation portion, comprising a first end and a second end, wherein the second radiation portion is L shaped, and the first end is connected to the first radiation portion; and a third radiation portion, wherein the second end is connected to the third radiation portion, and the feed conductor is corresponding to the second end, wherein the substrate comprises a first edge and a second edge, the first edge is perpendicular to the second edge, and the first radiation portion extends to the first edge, wherein the feed conductor is L shaped, the feed conductor comprises a first conductor section and a second conductor section, the first conductor section is perpendicular to the second conductor section, the first conductor section is corresponding to the second end, and the second conductor section is parallel to the second edge.

* * * * *